US005988116A

United States Patent [19]

Vago et al.

[11] Patent Number: 5,988,116

[45] Date of Patent: Nov. 23, 1999

[54] LOW $NO_X$ GAS BURNER AND METHOD OF OPERATION

[75] Inventors: Otto Z. Vago, Burns; Hector J. Donastorg, Clarksville; Clifford Carlton, Goodlettsville; William M. Pryor, Portland, all of Tenn.

[73] Assignee: State Industries, Inc., Ashland City, Tenn.

[21] Appl. No.: 09/159,449

[22] Filed: Sep. 24, 1998

Related U.S. Application Data

[63] Continuation of application No. 08/871,242, Jun. 9, 1997.

[51] Int. Cl.[6] ..... F22B 5/00

[52] U.S. Cl. ..... 122/14; 239/520; 239/567; 126/361; 126/39 R; 431/172; 431/8

[58] Field of Search ..... 431/171, 172, 431/8; 126/39 R, 39 H, 361; 239/554, 567, 520; 122/13.1, 14

[56] References Cited

U.S. PATENT DOCUMENTS

| | | | |
|---|---|---|---|
| 1,933,790 | 11/1933 | Crone | 431/172 |
| 3,992,137 | 11/1976 | Streisel | 239/554 |
| 4,372,290 | 2/1983 | Visos et al. | 239/104 |
| 4,951,614 | 8/1990 | Akkala et al. | 239/520 |
| 5,335,646 | 8/1994 | Katchka | 239/359 |
| 5,826,569 | 10/1998 | Voorhis | 431/171 |

FOREIGN PATENT DOCUMENTS

| | | | |
|---|---|---|---|
| 377377 | 12/1939 | Italy | 239/567 |

*Primary Examiner*—Carroll Dority
*Attorney, Agent, or Firm*—Paul R. Puerner

[57] ABSTRACT

A gas burner adapted to discharge said fuel at its the periphery for combustion, includes upper and lower concave plates secured together to define a chamber and an outer periphery having a plurality of burner ports. The upper plate preferably has a periphery extending radially at least as far as the lower plate. The periphery of the upper plate is downwardly angled, preferably more steeply than the periphery of the lower plate. The peripheral edge of at least one or the other of the top or bottom burner plates extends radially outwardly from the central axis a distance beyond the location of the burner ports and into the path of burning gases issuing from the ports whereby the temperature of said burning gases is reduced. Preferably, the periphery of the upper plate extends downwardly to an elevation below the upper edges of the burner ports, so that gases emerging from the ports are caused to impinge against the periphery, thus cooling the gases and thereby reducing the $NO_x$ content of the combustion gases.

5 Claims, 2 Drawing Sheets

LOW $NO_X$ GAS BURNER AND METHOD OF OPERATION

CROSS-REFERENCE TO RELATED APPLICATIONS

This is a continuation of application Ser. No. 08/871,242 filed Jun. 9, 1997 and now U.S. Pat. No. 5,913,675

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

This invention relates to gas burners and gas burner head configurations. More specifically, the invention relates to gas burners of the type typically used in water heaters.

Gas burners for domestic water heaters typically utilize burner heads formed from two concave halves which are secured together. See, for example, U.S. Pat. Nos. 3,992,137; 4,372,290 or 5,335,646. Such burners generally are supported by a bracket attached to the bottom concave portion which includes a central opening for inflow of an air-gas mixture. A plurality of burner ports are disposed in a spaced apart circular array around the periphery of the burner so that a ring of flames issues radially outwardly therefrom for heating the bottom wall of a water tank.

The combustion products of the heating process ideally would consist of carbon dioxide and water. However, if incomplete combustion occurs, carbon monoxide may be produced. Also, at elevated temperatures, a small amount of undesirable nitrogen oxide varieties such as nitric oxide (NO) and nitrogen dioxide ($NO_2$), generally collectively referred to as $NO_x$. Nitrogen dioxide, in particular, is objectionable because it is a brownish colored toxic gas which can support combustion. It is desirable and mandated by law that the $NO_x$ species be converted as efficiently as possible to gaseous nitrogen or other nontoxic forms. It has thus remained an ongoing goal of the industry and, in many places mandated by law to produce burners achieving higher combustion efficiency as well as minimization of $NO_x$ content of the exhaust gases.

Briefly, a gas burner of this invention is adapted to discharge fuel at its periphery for combustion. The burner includes upper and lower concave plates secured together to define a chamber and an outer periphery having a plurality of burner ports. The peripheral edge of the top plate is spaced radially outwardly from the central axis a distance beyond the location of the burner ports and into the path of burning gases issuing radially outwardly from the ports, whereby the temperature of said burning gases is reduced thereby reducing the $NO_x$ content of the gases.

BRIEF SUMMARY OF THE INVENTION

Not applicable.

BRIEF DESCRIPTION OF THE SEVERAL VIEWS OF THE INVENTION

DETAILED DESCRIPTION OF THE INVENTION

Figures 1, 2:
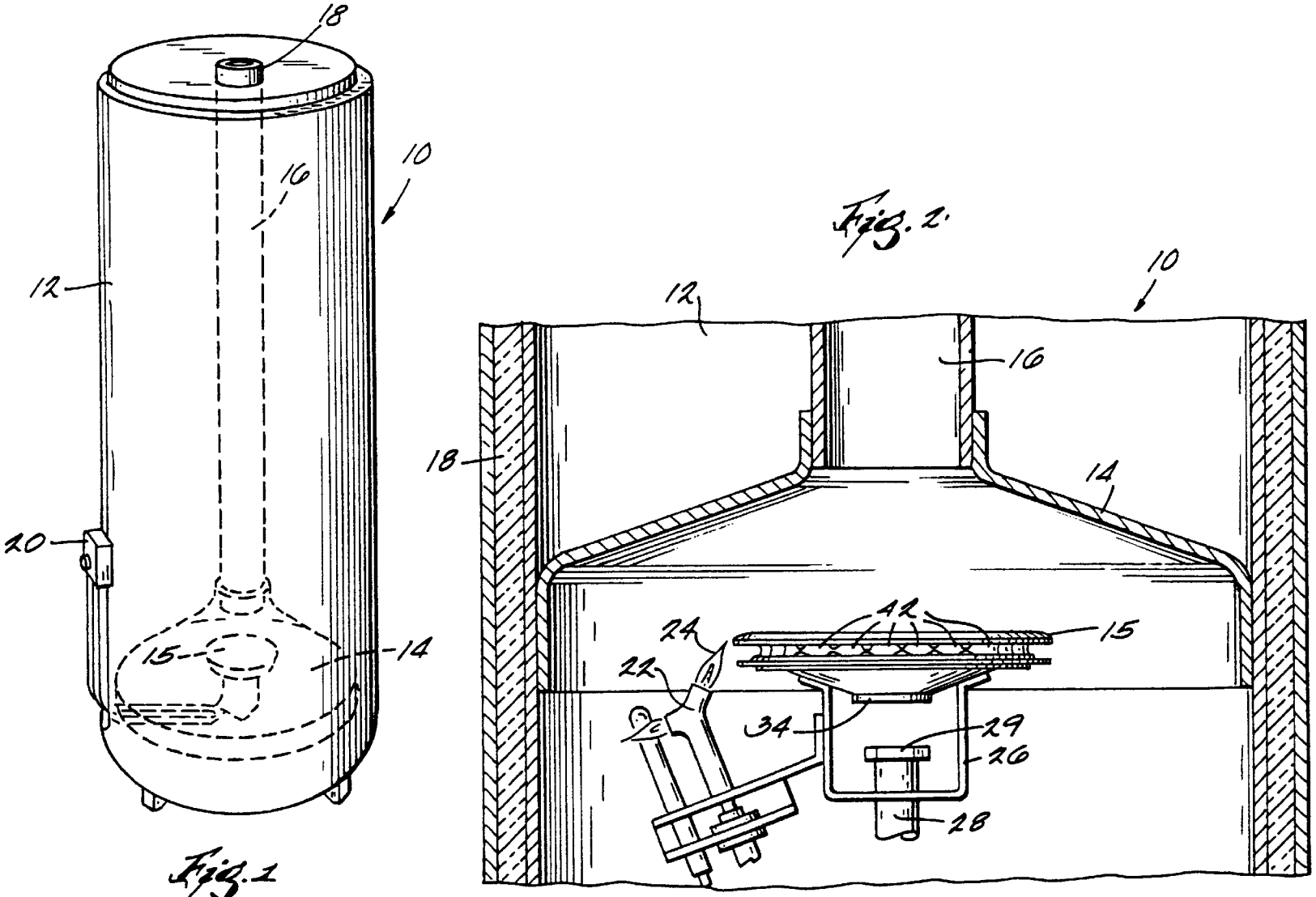
FIG. 1 is a perspective view, with interior parts shown by phantom lines, of a water heater incorporating the invention.
FIG. 2 is a fragmentary sectional view of the water heater of FIG. 1 showing the burner and pilot light assembly in side elevation.

Referring more specifically to FIG. 1, there is shown a water heater 10 incorporating a burner 15 of this invention. Water heater 10 includes a water-containing tank 12 provided with a bottom wall 14 and a centrally located exhaust flue 16. Exhaust flue 16 is vented through a fitting 18 to a suitable flue, all of conventional design. Commercially available temperature control devices 20, including suitable conventional thermostats, thermocouples and switches are also provided as is known in the art. Also provided are a pilot light, providing a pilot flame 24 for ignition of the burner 15, together with suitable associated controls of conventional design. Tank 12 is provided with a double walled configuration including suitable insulation 18.

Burner 15 includes a mounting bracket 26 fixed to its lower surface in accordance with known design. A gas conduit 20 is attached to a source of fuel such as a natural gas pipeline. In accordance with conventional practice, the tank of water heater 10 is also provided with intake pipes for inflow of cold water and outflow pipe connected to a commercial or domestic water system.

Figure 3:
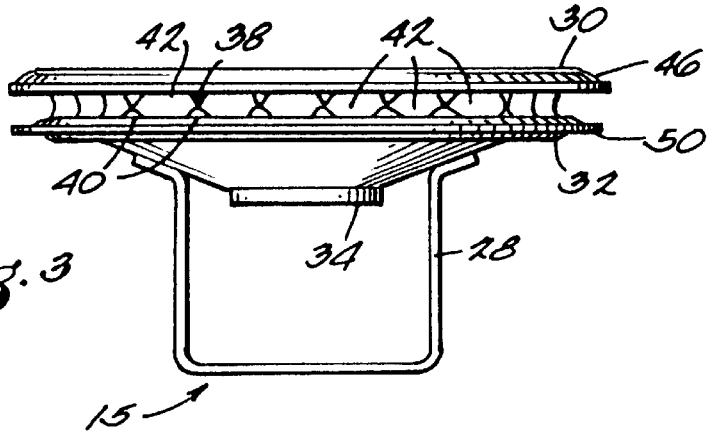
FIG. 3 is a side elevational view of the burner of this invention.
Figure 4:
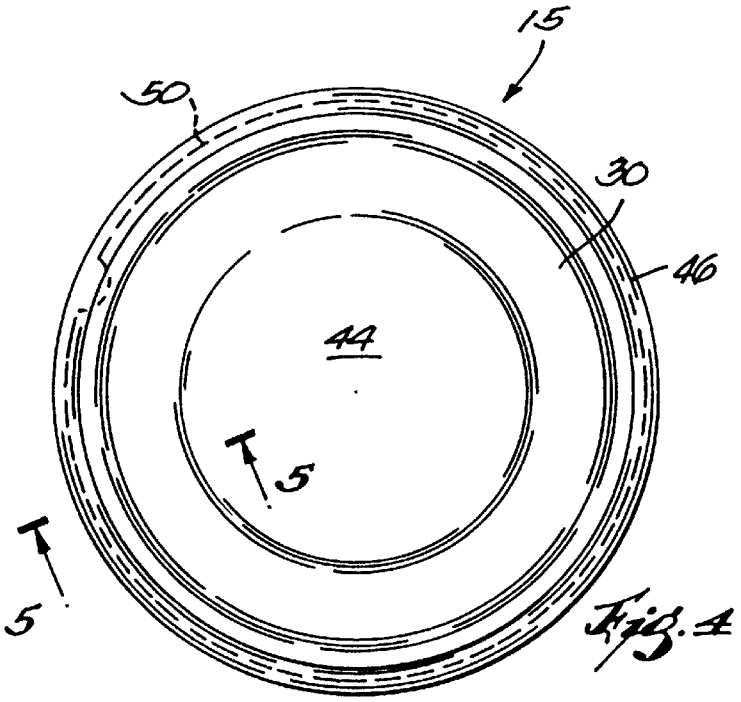
FIG. 4 is a top plan view of the burner shown in FIG. 3.
Figure 5:
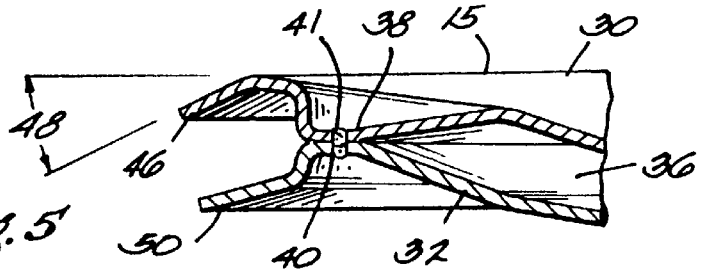
FIG. 5 is a fragmentary sectional view taken along line 5—5 of FIG. 4.

Gas conduit 28 is terminated by a gas discharge nozzle 29 which is centrally axially aligned with burner 15. Burner 15 includes top and bottom plates 30 and 32, respectively, each of which are preferably concavely shaped and formed of one piece. Lower plate 32 has a central opening 34 for receiving an inflow of gas from nozzle 29. Bottom plate 32 is downwardly concavely formed, as best seen in FIGS. 3 and 5. Plates 30 and 32 together form a chamber 36 which receives the flow of gas. Plates 30 and 32 are formed with a plurality of flutes 38 and 40 around their respective peripheries.

The flutes 38 and 40 are connected together by means of a rivet 41 as seen in FIG. 5, or, alternatively by means of spot welding. Angle 48 is preferably about 27° so that its peripheral edge 46 extends into the flow path of the flaming gases at a location where they are exiting ports 42 in a radial direction.

The fluted portions 38 and 40 define the ports 42 with the flutes 38 and 40 preferably being secured together by small rivets. As illustrated, preferably both the top plate 30 and the bottom plate 32 are circular in configuration. The burner openings 42 defined by the flutes 38, 40 preferably extend around the entire periphery of the burner 15.

As noted, gas, for example propane or natural gas, is discharged through orifice 29, supplied by gas supply conduit 28, while combustion air is provided by the ambient atmosphere. The gas flowing through opening 34 flows upwardly and impinges against the inner surface of the concavely depressed portion 44 of upper plate 30. Thereafter, the gas flows uniformly radially outward in all directions toward, and out through, the plurality of burner ports 42.

In accordance with one of the novel aspects of the present invention, the peripheral edge 46 of upper plate 30 is angled downwardly at an angle 48, preferably approximately 27°, as best seen in FIG. 5. Peripheral edge 50 of lower plate 32 extends at a shallower angle, preferably approximately 15° from the horizontal. It will thus be noted that, in the illustrated preferred embodiment, the peripheral edges 46 and 50 converge toward each other.

It will also be noted from FIGS. 2–5 that the upper plate 30 is formed all of one piece and is of a greater diameter than the lower plate 50. It will also be noted, for example from FIG. 3, that the peripheral edge 46 of upper plate 30 extends downwardly a sufficient amount to be positioned in front of the upper edges of each of the openings 42 which form the gas bumer ports. Thus, the burning gases exiting the ports 42 will support combustion of the gases exteriorly of the chamber 36. The burning gases are caused to impinge while they are traveling radially outwardly from the burner ports, against the peripheral edge 46 of plate 30. This impingement has been found to beneficially lower the temperature of the burning air-gas mixture exiting the ports, which is important in the reduction of $NO_x$ content of the resultant combustion products.

All of these novel aspects of the present invention are believed to interrelate and combine to form a configuration which promotes efficient burning of the fuel to minimize undesirable carbon monoxide or similar emissions while reducing the $NO_x$ concentration of the exhaust gases to a reduced level which meets all applicable mandated maximum levels of such waste products. Emission tests conducted on the burners of the preferred embodiment shown herein were found to produce emission test results showing that $NO_x$ emissions were under the required 40 nanogram per Joule of useful heat output which represents the most stringent current state governmental requirements.

While various preferred embodiments and features of the invention have been shown herein for purposes of illustration, it will be appreciated by those skilled in the art that various modifications thereof may be made within the scope of the appendant claims and spirit of the invention. It will also be understood that while the invention has been illustrated in conjunction with a water heater tank that the burner described herein can be utilized in connection with any similar device or tank which needs to be heated.

While the invention has been herein shown and described in what is presently conceived to be the most practical and preferred embodiment, it will be obvious to one of ordinary skill in the art that modifications may be made thereof within the scope of the invention, which scope is not to be limited except by the appended claims.

What is claimed is:

1. The method of reducing the $NO_x$ characteristics of the gas burner flame emanating from a gas burner in a gas-fired water heater, said gas burner adapted to receive fuel gas from a gas inlet conduit and to discharge said fuel at a periphery of said burner for combustion, said burner including upper and lower concave plates secured together to define a plurality of burner ports, said burner having a central axis, comprising the steps of:

a) introducing the fuel gas into the chamber between the upper and lower plates of the burner;

b) directing the fuel gas to said burner ports;

c) burning the fuel gas exteriorly of the burner ports;

d) directing the burning fuel gas around the periphery of the combustion chamber in the form of individual flames of burning gas;

e) deflecting the flow of burning gas emanating from the ports to thereby reduce the temperature of the flames of burning gas.

2. The method of claim 1 wherein the peripheral edge of the upper plate is angled downwardly from the horizontal to thereby deflect the flow of burning gas emanating from the ports.

3. The method of claim 2 wherein the peripheral edge of the upper plate is angled downwardly from the horizontal approximately 27°.

4. The method of claim 1 wherein the peripheral edge of said upper plate is angled downwardly to an elevation below the elevation of the upper edges of said burner ports.

5. The method according to claim 1 wherein the downwardly angled peripheral edge of said upper plate is spaced radially from said central axis a distance at least equal to the distance that the peripheral edge of the lower plate extends from the central axis.

* * * * *

UNITED STATES PATENT AND TRADEMARK OFFICE

CERTIFICATE OF CORRECTION

PATENT NO. : 5,988,116

DATED : November 23, 1999

INVENTOR(S) : Otto Z. Vago et al

It is certified that errors appear in the above-identified patent and that said Letters Patent is hereby corrected as shown below:

Abstract, Line 1, After "discharge" and before "fuel", delete ---said---
After "its" delete ---the---

Column 1, Line 37, After "$NO_x$" and before the period, insert ---is produced---

Column 3, Line 11, After "the" and before "gases", delete ---burning---

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*